US006422934B1

(12) United States Patent
Blach et al.

(10) Patent No.: US 6,422,934 B1
(45) Date of Patent: Jul. 23, 2002

(54) SKATE SHARPENER

(75) Inventors: Wolfgang Blach, St-Laurent; Jaroslav Krajic, Dollard-des-Ormeaux; Josef Slanik, Kirkland, all of (CA); Murray David Wilson, 621 Poplar Bluff Dr. No. 1, Harrow, Ontario (CA), N0R 1G0

(73) Assignee: Murray David Wilson, Harrow (CA)

( * ) Notice: Subject to any disclaimer, the term of this patent is extended or adjusted under 35 U.S.C. 154(b) by 0 days.

(21) Appl. No.: 09/575,624

(22) Filed: May 22, 2000

Related U.S. Application Data

(60) Provisional application No. 60/135,415, filed on May 21, 1999.

(51) Int. Cl.[7] ..... B24B 7/00

(52) U.S. Cl. ..... 451/541; 451/383; 451/224

(58) Field of Search ..... 451/541, 72, 45, 451/321, 322, 383, 241, 224

(56) References Cited

U.S. PATENT DOCUMENTS 813,142 A * 2/1906 Dilg ..... 451/383
1,155,706 A * 10/1915 Darling ..... 451/383
3,719,006 A * 3/1973 Vezeau ..... 451/241
3,988,865 A * 11/1976 Weisman ..... 451/383
4,055,026 A * 10/1977 Zwicker ..... 451/383
4,558,541 A * 12/1985 Consay ..... 451/224
5,287,657 A * 2/1994 Tschida et al. ..... 451/224

* cited by examiner

*Primary Examiner*—Joseph J. Hail, III
*Assistant Examiner*—Hadi Shakeri
(74) *Attorney, Agent, or Firm*—Eric Fincham

(57) ABSTRACT

A skate sharpening apparatus includes a skate blade holding device, the skate blade sharpening device having a horizontally mounted sharpening wheel which is rotatably driven, and wherein the skate holding device has first and second jaws for contacting opposite sides of a skate blade. First and second pivot arms each having first and second ends with the pivot arms being mounted intermediate the first and second ends are arranged such that the first ends of each of the arms are connected to the first and second jaws respectively. A linearly moveable actuator moves second ends of each of said first and second pivot arms, the linearly moveable actuator causing each of the pivot arms to move an equal distance and therefore move each of the jaws in equal distance, with a center line of the linearly moveable actuator lying in the same plane as a center line extending through a skate blade held between the jaws and a center line extending through the sharpening wheel. The arrangement is such that a perfectly centered sharpening of the skate blade is achieved irregardless of the skate blade width.

12 Claims, 7 Drawing Sheets

SKATE SHARPENER

This application claims benefit of Prov. No. 60/135,415 filed May 21, 1999.

The present invention relates to the field of skate sharpening and more particularly, relates to improvements in skate sharpening machines.

The field of skate sharpening is replete with examples of various types of devices which may be used for sharpening skates. Such devices are required to be very precise.

As in most sports, the continual improvement of the athlete and the striving for new goals requires technically advanced equipment. In both figure skating and hockey, the skates and more particularly the blade are the point of contact for all movements and the science of the shape and configuration of the blade has advanced considerably. Thus, the bottom surface of the blade is required to have a convex configuration whereby the blade has two edges which extend downwardly and permit the skater to use either edge. In order to achieve this configuration, the skate sharpening device must be configured to provide this U-shaped configuration wherein the two edges are precisely the same and provide an angle of 90° with respect to the side of the blade.

As skate blades differ from one pair to another, the sharpening of the skate blade to achieve the desired profile has long been regarded as an art to be practiced by the operator of the skate sharpening machine. The operator must first dress the stone to have the required configuration and then ensure that the center line of the stone and center line of the skate coincide. If not, an irregular convex configuration with one edge being higher/lower than the other may be achieved.

In order to accomplish the above, the operator of the skate sharpening device will usually perform a first test on a small portion of the skate at the front or rear of the blade and then make adjustments in the device. This may be repeated a number of times before the precise matching of the skate and stone is achieved.

It is an object of the present invention to provide a skate sharpening machine which provides for precise alignment of the center line of the sharpening stone and the skate blade to be sharpened.

In general, the device of the present invention utilizes a pair of gripping jaws designed to grip opposite sides of the skate blade, and which gripping jaws are operated from a single adjusting means such that, irrespective of the width of the skate blade, the centering of the stone and skate blade is assured.

In one aspect of the present invention, there is provided an improvement in a skate sharpening apparatus having a skate holding device, the improvement wherein the skate holding device, comprises first and second jaws for contacting opposite sides of a skate blade, first and second pivot arms each having first and second ends with each pivot arm being pivotably mounted intermediate the first and second ends, the first ends of each of the first and second pivot arms being connected to the first and second jaws respectively, actuating means for moving the second ends of each of the first and second pivot arms, the actuating means being operative to cause each of the pivot arms and the jaws to move an equal distance.

In a further aspect of the present invention, there is a provided a skate sharpening apparatus including a skate blade holding device, the skate blade sharpening device comprising a horizontally mounted sharpening wheel, means for rotatably driving the sharpening wheel, means for dressing the sharpening wheel, and a skate holding device comprising first and second jaws for contacting opposite sides of a skate blade, first and second pivot arms each having first and second ends with each pivot arm being mounted intermediate the first and second ends, the first ends of each of the first and second pivot arms being connected to the first and second jaws respectively, actuating means for removing the second ends from each of the first and second pivot arms, the actuating means being linearly driven and operative to cause each of the pivot arms and the jaws to move an equal distance, a center line of the linearly moveable actuating means extending in the same plane as a center line extending through the skate blade and a center line extending through the sharpening wheel.

In greater detail, the skate holding device according to a preferred embodiment of the invention includes an arrangement wherein the actuating means comprises first and second linking arms. Each of the linking arms are connected to the actuating means which are linearly driven. Conveniently, the linking arms may be mutually pivotably connected about a shaft. The opposite end of the linking arms are connected to the end of a respective pivot arm.

The pivot arms, as aforementioned, are pivotably connected intermediate their first and second ends with one end, as aforementioned, being connected to the linking arm and the other end being connected to a jaw.

Each of the jaw members preferably comprises a jaw plate member although each jaw is designed somewhat differently. For purposes of description herein, reference will be made to an upper jaw member and a lower jaw member as this is the preferred orientation of the device with respect to a sharpening apparatus. However, it will be understood that other orientations, with suitable adjustments, may be utilized.

The lower jaw plate member preferably has a flat jaw edge where it contacts the skate blade. Also, the lower jaw plate member is preferably not fixedly secured to the lower pivot arm, but rather rests thereon and is guided in such a manner that it is vertically moveable rather than through an arcuate configuration.

The upper jaw member preferably has two finger portions which are adapted to contact the skate blade and preferably, the jaw is pivotably mounted. The upper jaw edge is preferably of an arcuate configuration as it is fixedly attached to the upper pivot arm.

In use with a skate sharpening apparatus, the center line of the linearly moveable actuator lies in the same plane as the center line of the skate blade and the center line of the sharpening wheel for reasons which will become apparent hereinbelow.

An embodiment of the present invention will be described with respect to the accompanying drawings, in which.

Figure 1:
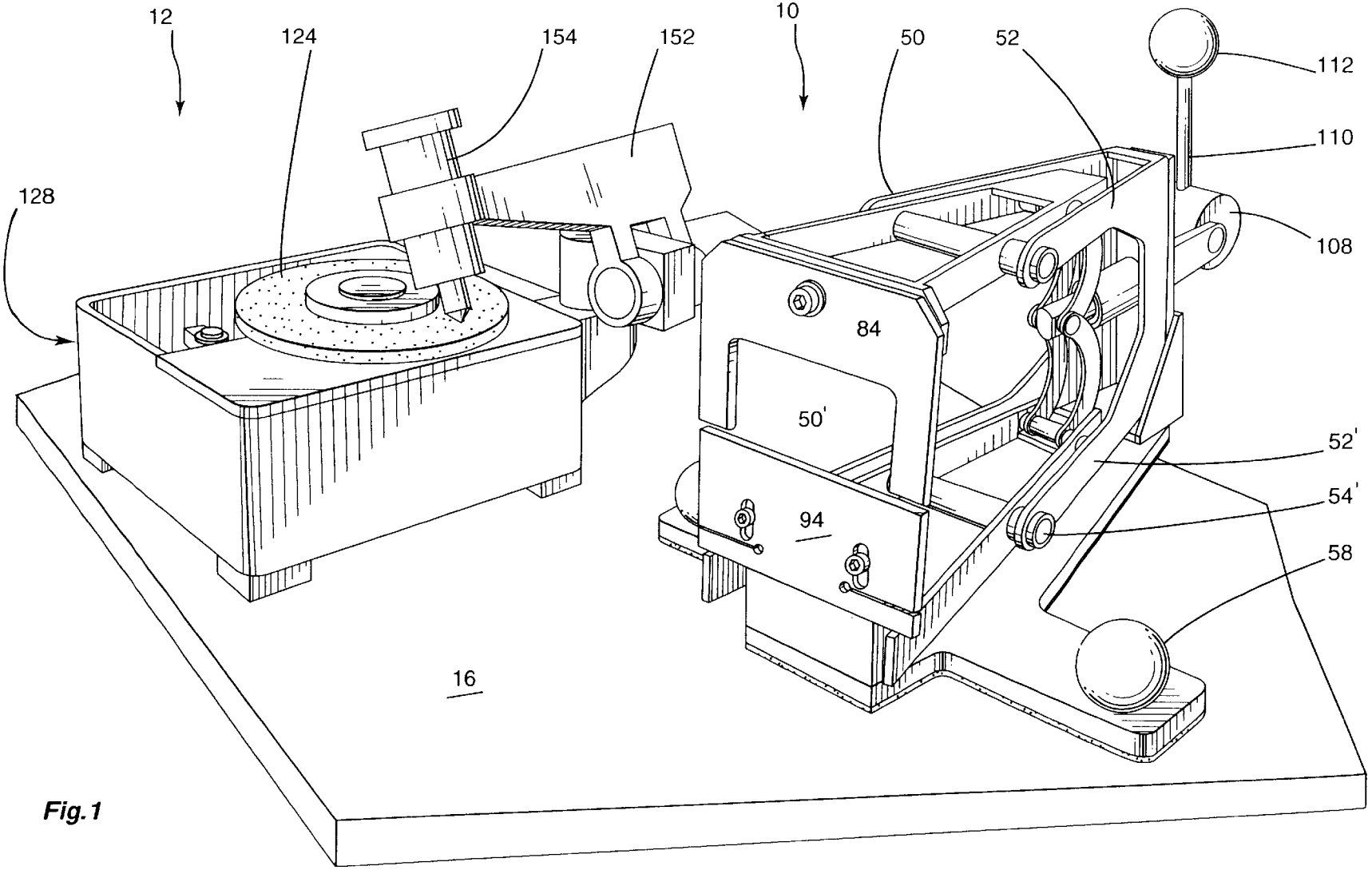
FIG. 1 is a perspective view of a skate blade holding apparatus and a skate blade sharpening device according to one embodiment of the present invention.
Figure 2:
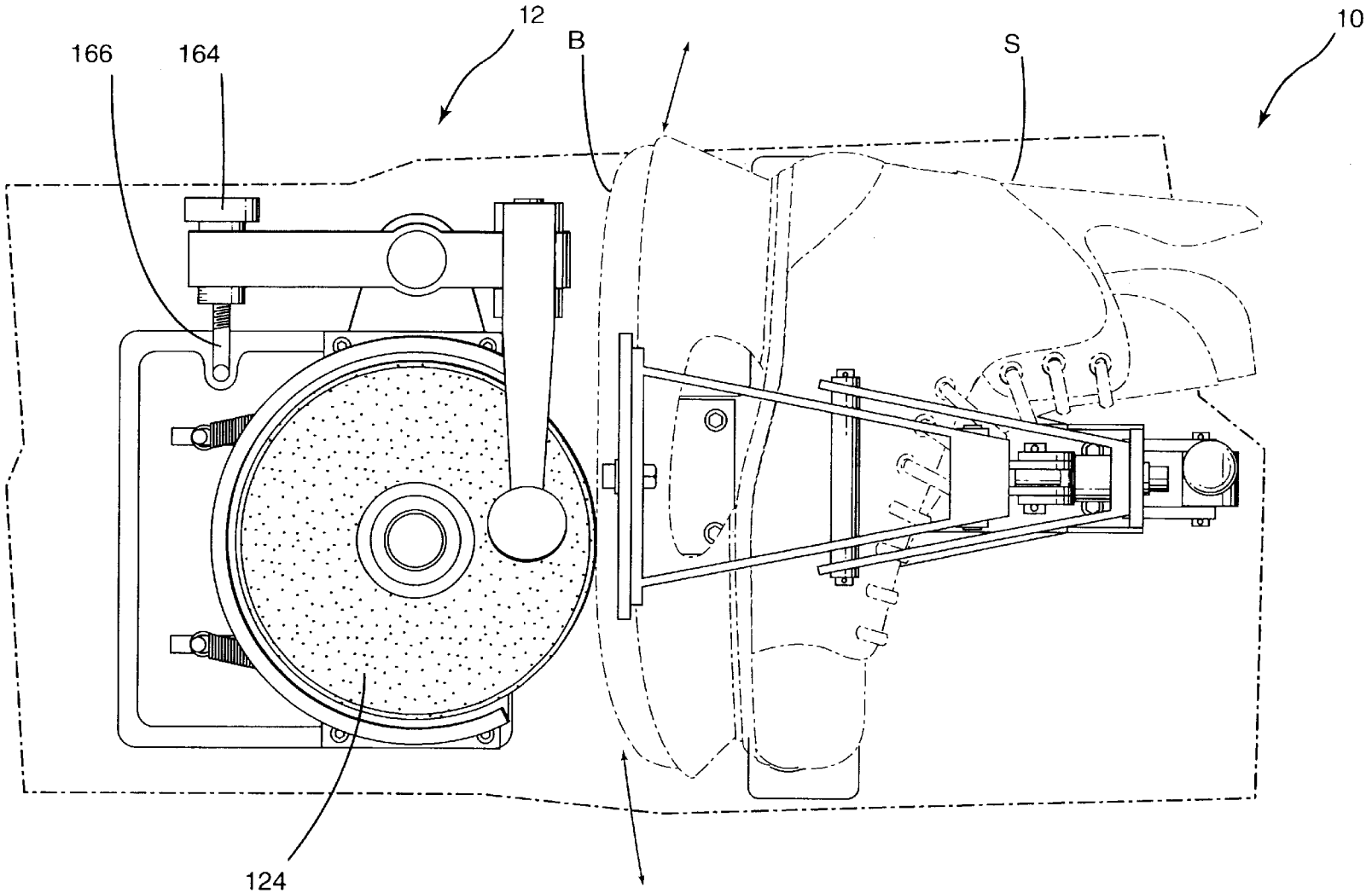
FIG. 2 is a top plan view thereof.
Figure 3:
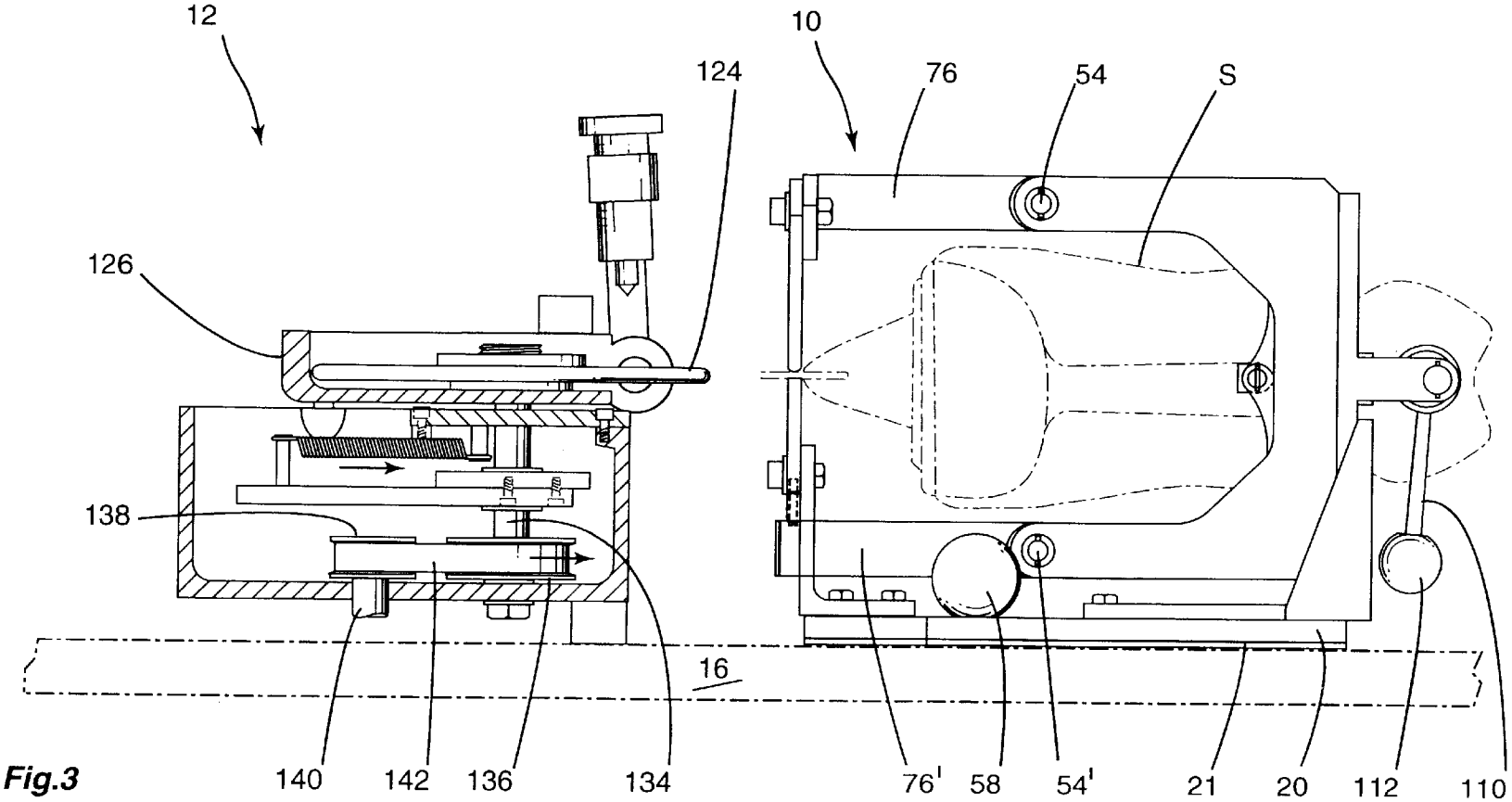
FIG. 3 is a side elevational view thereof with the skate blade sharpening apparatus being partially in cross section.

Referring to the drawings in greater detail and by reference characters thereto, there is illustrated a skate blade holding apparatus generally designated by reference numeral 10 and also a skate blade sharpening apparatus generally designated by reference numeral 12. Both are mounted on top of a substrate 16 which may be a suitable table or other working surface.

Skate blade holding apparatus 10 is best illustrated in FIGS. 3 to 7 and reference will now be made thereto. Skate blade holding apparatus 10 includes a base 20 having a layer 21 on the bottom thereof to permit movement along substrate 16. Any suitable material may be used and preferably layer 21 is of a low friction material with respect to the material forming substrate 16—i.e. a low friction plastic, felt, etc.

Skate blade holding apparatus 10 includes a rear L-shaped frame member generally designated by reference numeral 22 and which frame member 22 includes a horizontal portion 24 and a vertical portion 26. Horizontal portion 24 is secured to base 20 by means of bolts 28. A vertical frame member 30 is, in turn, secured to vertical portion 26 of frame member 22 by means of bolts 32.

Skate blade holding apparatus 10 also includes a front L-shaped frame member generally designated by reference numeral 36 and which includes a horizontal portion 38 and a vertical portion 40. Horizontal portion 38 is secured to base 20 by means of bolts 42.

Figure 6:
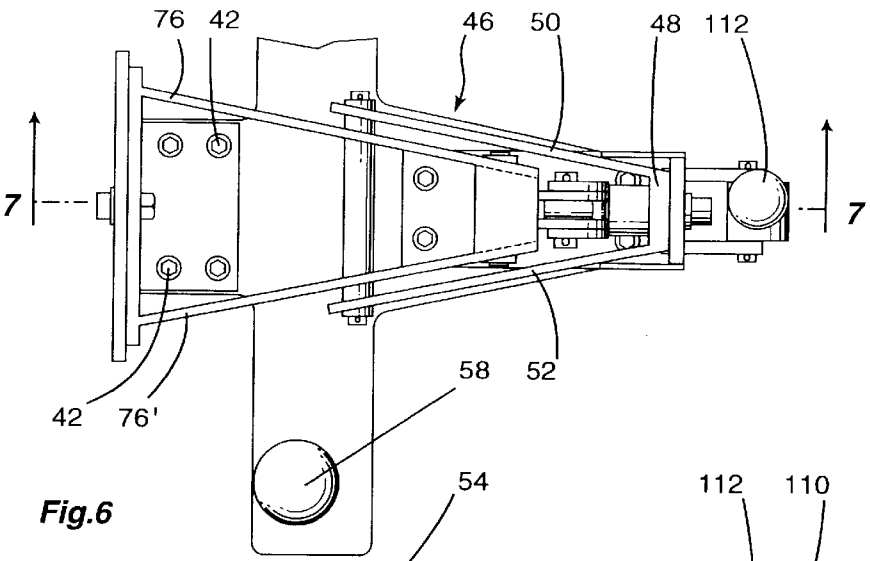
FIG. 6 is a top plan view of the skate blade holding apparatus.
Figure 5:
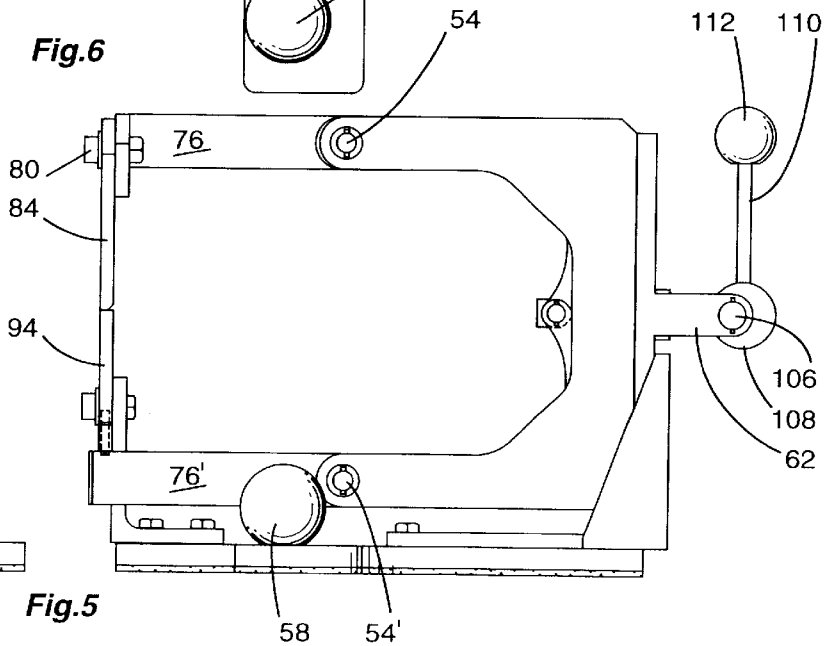
FIG. 5 is a side elevational view of the skate blade holding apparatus.

As may be best seen in FIGS. 1 and 6, the frame includes a V-shaped upper frame portion 46 which is comprised of a base 48 and first and second arms 50 and 52 respectively. Extending between arms 50 and 52 is shaft 54. A lower V-shaped frame portion having arms 50', 52' and shaft 54' is likewise provided.

On the upper portion of base 20 there are provided handles 58 to permit the operator of the skate blade holding apparatus 10 to move the apparatus as desired.

Mounted within a horizontal housing 62 and extending through vertical frame member 30 is a linearly driven actuator 66 mounted in a bushing 64.

Described hereinbelow will be operation of the device with the use of linking arms and pivoting arms. In this respect, it should be noted that these arms are symmetrical about a horizontal plane extending through linearly moveable actuator 66 and thus, only one will be described herein with similar reference numerals with a prime being used for the other side.

Figure 7:
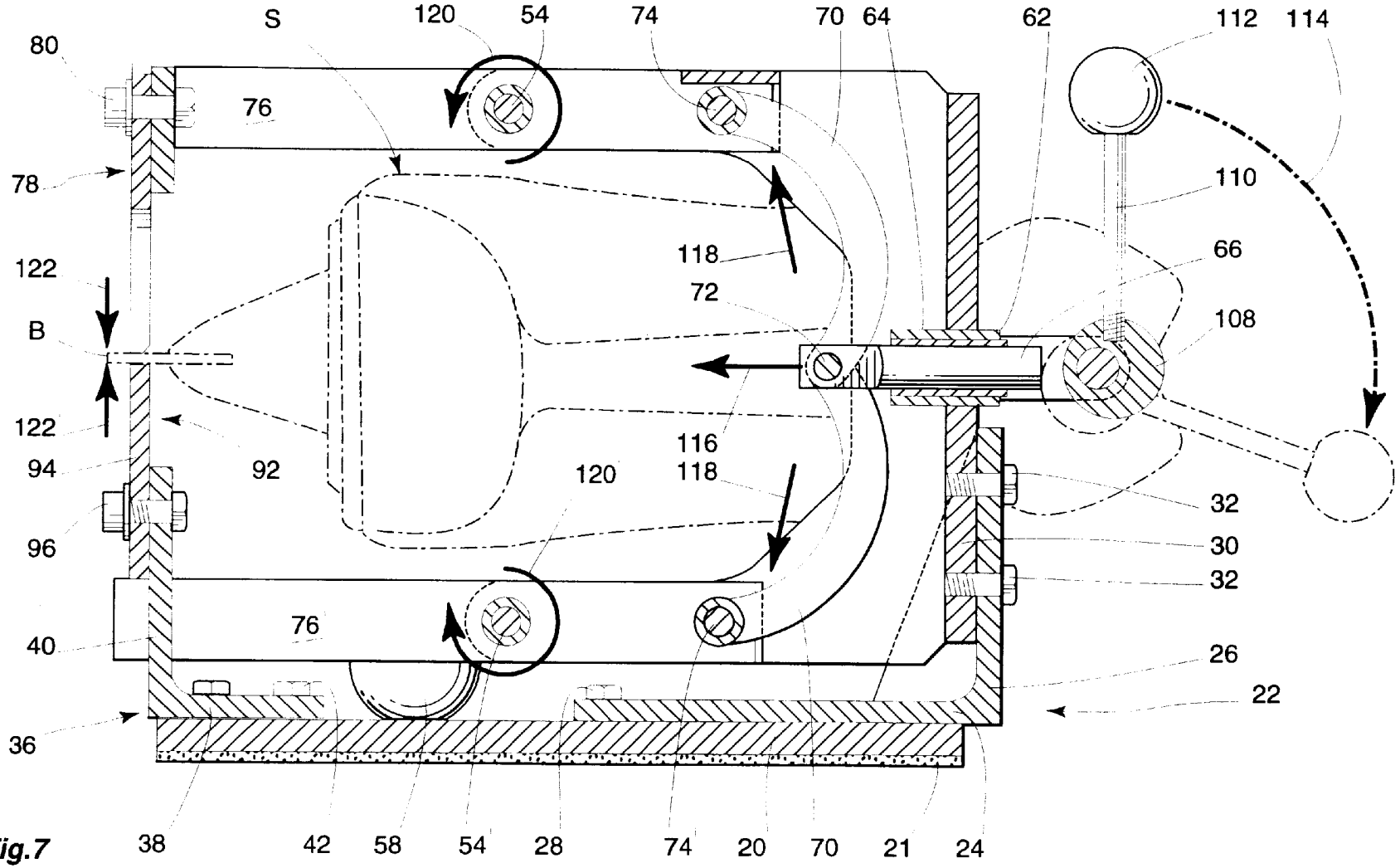
FIG. 7 is a cross sectional view taken along the lines 7—7 of FIG. 6.
Figure 8:
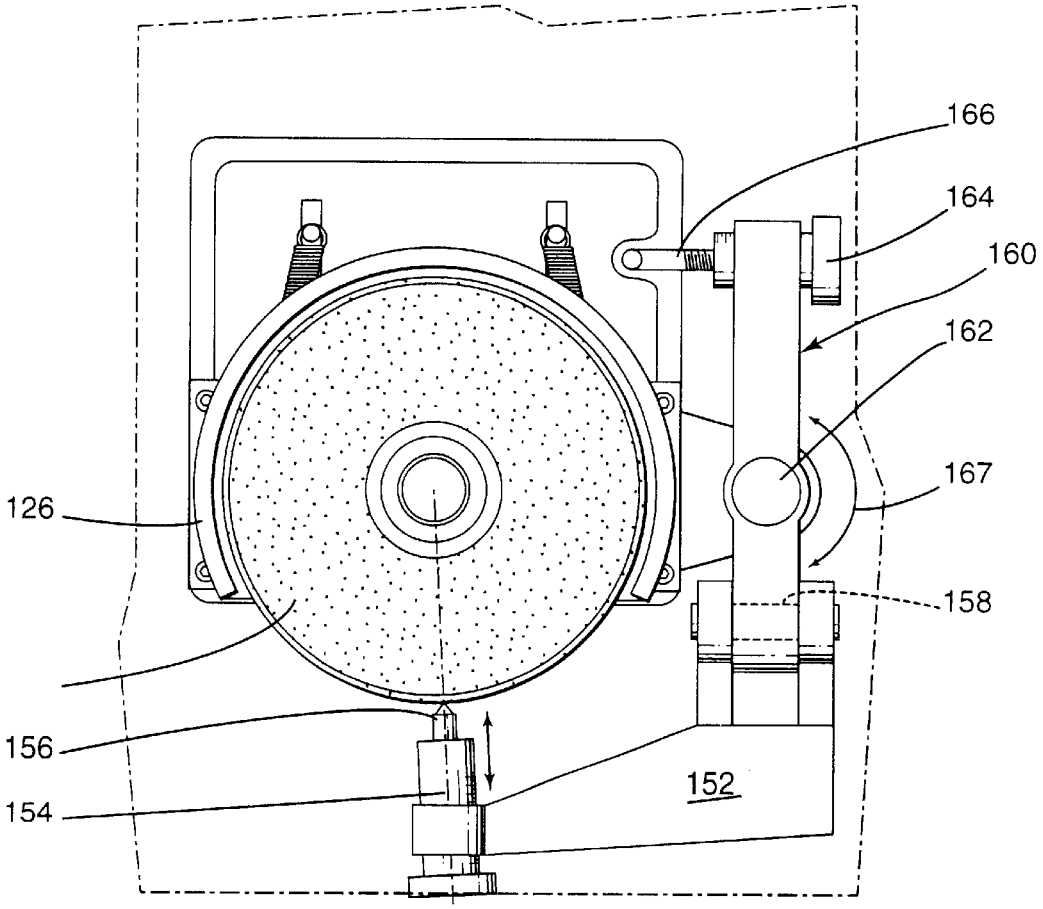
FIG. 8 is a top plan view of the skate blade sharpening apparatus.
Figure 9:
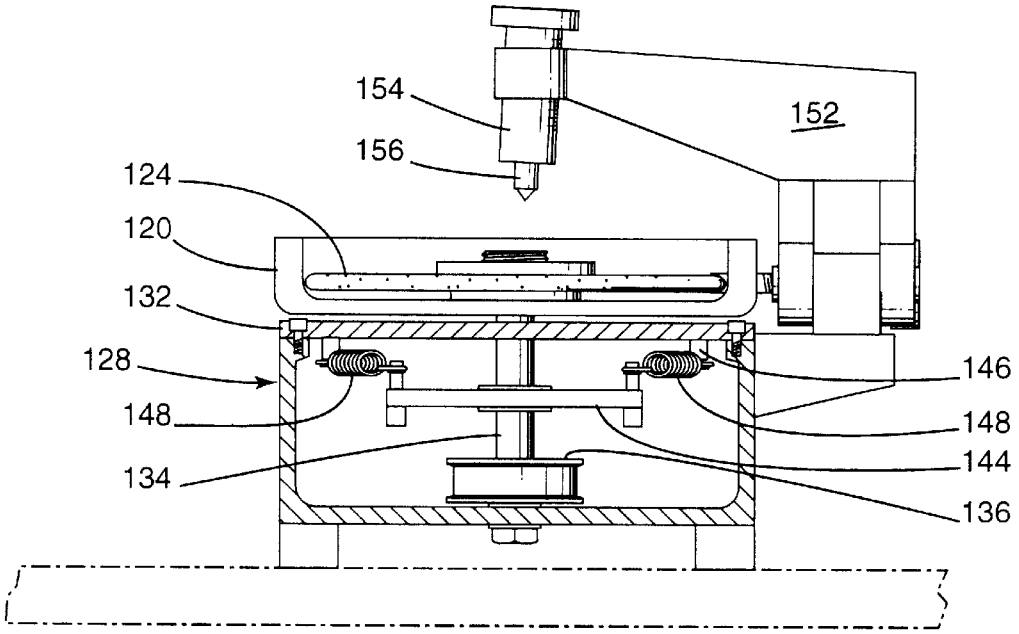
FIG. 9 is side view, partially in section, of the skate blade sharpening apparatus of FIG. 8.
Figure 10:
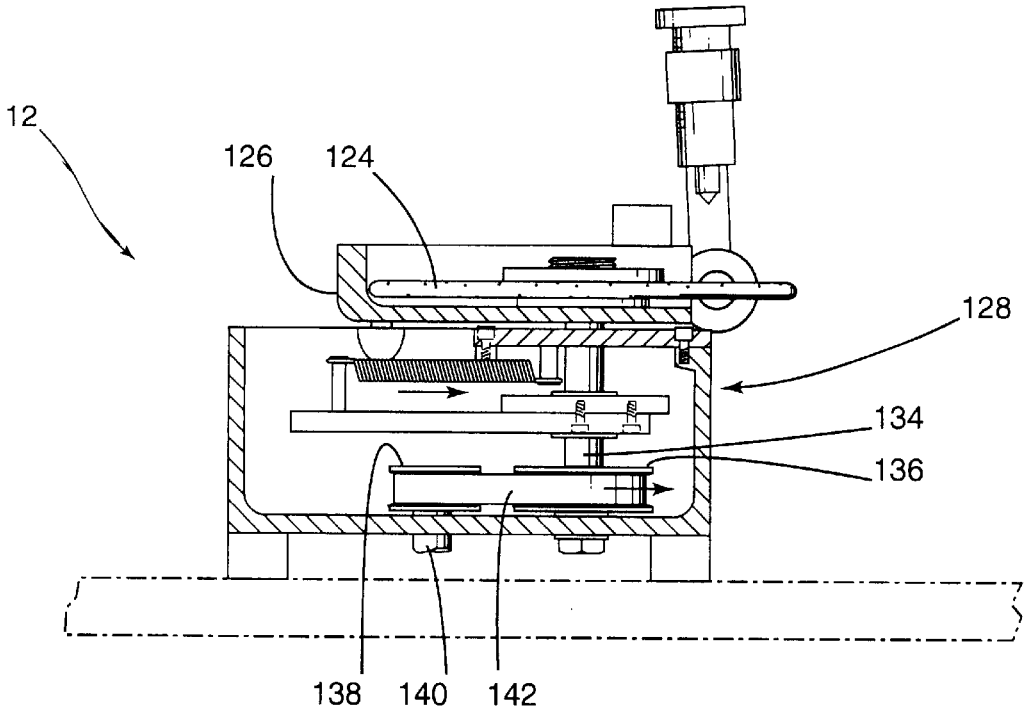
FIG. 10 is a cross-sectional view from the front.

As best seen in FIG. 7, C-shaped linking arms 70, 70' extend outwardly from opposite sides of actuator 66 and are pivotably secured thereto by means of a pin 72. At its other end, linking arm 70 is pivotably secured to a pivot arm 76 by means of pin 74. Pivot arm 76 is pivotably mounted about shaft 54 which in turn is maintained in position by frame arm 50.

At its second end, a jaw member 78 is secured to pivot arm 76 by means of a bolt 80.

Figure 4:
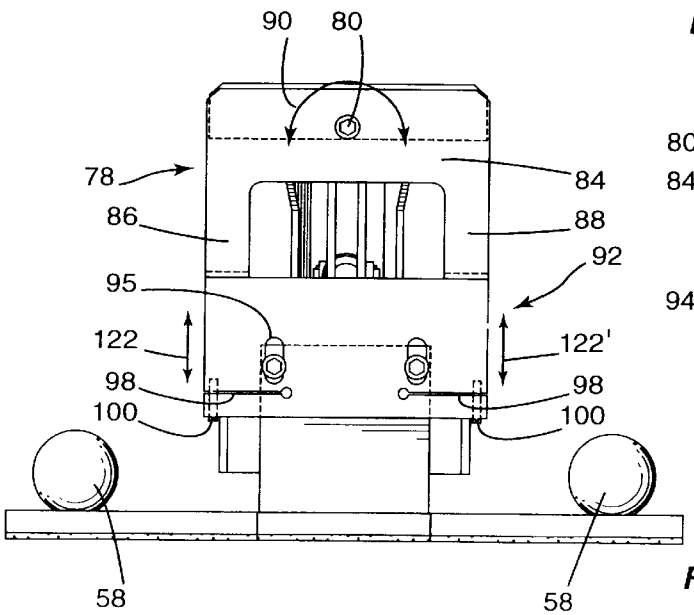
FIG. 4 is an end elevational view of the skate blade holding apparatus.

Jaw 78, as may be best seen in FIG. 4, comprises an upper jaw plate member 84 which has a pair of fingers 86 and 88 extending downwardly therefrom to contact a skate blade B. The mounting is such so as to permit pivotable movement about bolt 80 as indicated by arrow 90. This arrangement ensures that both fingers 86 and 88 apply equal pressure to skate blade B.

Similarly, lower pivot arm 76' is designed to receive a lower jaw generally designated by reference numeral 92 and which, as may be seen in FIG. 4, comprises a lower jaw plate member 94. Lower jaw plate member 94 is not secured to lower pivot arm 76', but rather there are provided bolts 96 which act as guide members within slots 95 while permitting movement of lower jaw plate member 94. Using this arrangement, it will be seen that lower jaw member 94 which has a lower jaw edge 102 formed with a flat surface for contacting blade member B thus will always move in a true vertical direction. This maintains the proper pressure and avoids an angular pressure on the skate blade B which would be the case if lower jaw plate member 94 were secured to lower pivot arm 76' —i.e. in that instance, it would then move in an arcuate path.

Figure 11:
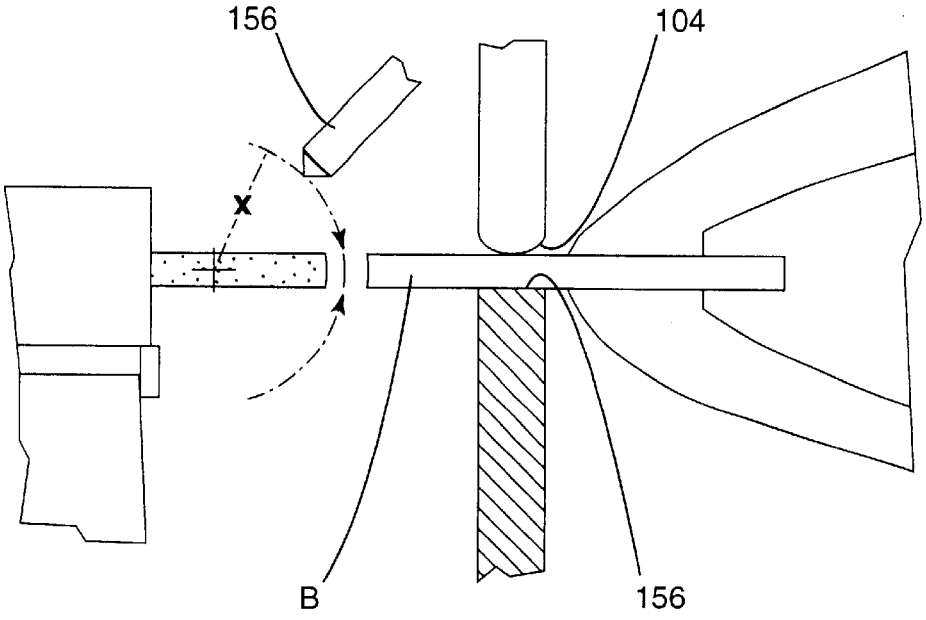
FIG. 11 is a schematic view illustrating use of the dressing of the stone and the relationship thereof to the sharpening of the skate blade.

Lower jaw plate member 94, as seen in FIG. 4, includes a pair of horizontal slots 98 at opposite sides thereof. In turn, a set screw 100 is provided with each horizontal slot 98. The reason for this is to permit a very fine adjustment to the height of lower jaw plate member 94 when the device is initially set-up. It has been found that the modulus of the material used for the lower jaw plate member can vary from one region of the plate member to another providing for unequal forces from lower jaw edge 102 on skate blade B. In turn, the rotational movement of upper jaw plate member 84 about bolt 80 ensures that upper jaw edge 104 contacts in a smooth manner. Preferably, upper jaw edge 104 is of a somewhat arcuate configuration as seen in FIG. 11.

Mounted eccentrically to housing 62 by means of mounting pin 106 is cam member 108. Screw threadedly engagable with cam 108 is a shaft 110 having handle 112 at the distal end thereof.

As shown in FIG. 7 and as indicated by arrow 114, handle 112 may be moved through the arc to the position shown in dotted lines causing cam 108 to contact linear actuator 66. This in turn forces linear actuator to the left as indicated by arrow 16 and causes a pivotable movement and force on linking arms 70, 70' as indicated by arrows 118. In turn, pivot arms 76, 76' will rotate about shaft 54 as indicated by arrows 120, 120' and cause upper jaw 78 and lower jaw 92 to move in the directions indicated by arrows 122, 122' respectively.

As previously mentioned, this arrangement provides for a skate blade holding apparatus which can adapt to various skate blade thicknesses and ensure that the bottom of the skate blade B is also always vertically oriented. In this respect, it will be noted that the center line of actuator line 66 is the same as the center line of skate blade B.

Reference will now be made to skate blade sharpening apparatus 12 and which is best illustrated in FIGS. 3, 8, 9 and 10.

Skate blade sharpening apparatus 12 includes a grinding wheel 124, partially surrounding which is a grinding wheel housing 126. Skate blade sharpening apparatus 12 includes a frame generally designated by reference numeral 128 and which includes an upper plate 130 secured to side frame members by means of screws 132. Operatively connected to grinding wheel 124 is a grinding wheel shaft 134 which, at its lower end, has a grinder wheel shaft pulley wheel 136. A drive pulley 138 is mounted on a drive pulley shaft 140 with a drive belt 142 extending between pullies 136 and 138 in a conventional manner.

Located at the upper portion of grinding wheel shaft 134 is a lower shaft plate 144. Studs 146 are mounted to a upper plate 130. As may be best seen in FIG. 9, a pair of spring members 148 extend between and are connected to lower plate 144 and studs 146. Spring members 148 thus serve to continually tension drive belt 142.

There are also provided means for dressing the grinding wheel and reference may be had to FIGS. 8 to 11 illustrating the arrangement.

A longitudinally extending member 60 is rotatably mounted on a shaft 162 and may move as shown by arrow 166. At one end thereof, there is provided a further shaft 158 on which is mounted a pivotable arm 152. In turn, at the opposite end of arm 152, there is provided a dressing member holder 154 holding dressing stone 156.

At the other end, member 160 is provided with an adjustment screw 166 engageable with upper plate 130. Thus, by means of a handle 164, adjustment screw 166 provides for fine adjustment of member 160 and thus the location of dressing stone 156.

It will be understood that the above described embodiments are for purposes of illustration only and that changes and modifications may be made thereto without departing from the spirit and scope of the invention.

We claim:

1. In a skate sharpening apparatus having a skate holding device, the improvement wherein said skate holding device comprises:

first and second jaws for contacting opposite sides of a skate blade;

first and second pivot arms each having first and second ends with each pivot arm being pivotably mounted intermediate said first and second ends;

said first ends of each of said first and second pivot arms being connected to said first and second jaws respectively;

actuating means for moving said second ends of each of said first and second pivot arms, said actuating means being operative to cause each of said pivot arms and said jaws to move an equal distance, said actuating means including first and second linking arms, each of said linking arms having a first end thereof connected to said second end of a respective one of said first and second pivot arms, said second ends of each of said first and second linking arms being connected to a linearly moveable actuator.

2. The improvement of claim 1 wherein each of said second ends of said linking arms is equally spaced from a center line of said linearly moveable actuator, said center line also being a center line for a skate blade held between said first and second jaws.

3. The improvement of claim 1 wherein said first jaw comprises a first jaw plate member, said first jaw plate member having a substantially flat jaw edge, said first jaw plate member being mounted to permit linear movement thereof such that said first flat jaw edge remains parallel to a side of a skate blade held between said first and second jaws.

4. The improvement of claim 3 wherein said second jaw comprises a second jaw plate member, said second jaw plate member having first and second skate blade contacting fingers, said second jaw plate member being pivotably connected to said first end of said second pivot arm.

5. The improvement of claim 4 wherein said first and second skate blade contacting fingers each have an arcuate jaw edge for contacting said skate blade side.

6. The improvement of claim 4 wherein said first jaw comprises a lower jaw and said second jaw comprises an upper jaw.

7. The improvement of claim 2 wherein said linearly moveable actuator includes an eccentrically mounted cam contacting said linearly moveable actuator and handle means for moving said cam.

8. The improvement of claim 6 wherein said first jaw plate member includes a plurality of generally horizontal slots formed therein, and means for adjusting a width of said slots to thereby adjust a height of said first jaw plate member.

9. A skate sharpening apparatus including a skate blade holding device, the skate blade sharpening device comprising a horizontally mounted sharpening wheel, means for rotatably driving said sharpening wheel, means for dressing said sharpening wheel, and a skate holding device comprising first and second jaws for contacting opposite sides of a skate blade, first and second pivot arms each having first and second ends with each pivot arm being mounted intermediate said first and second ends, said first ends of each of said first and second pivot arms being connected to said first and second jaws respectively, actuating means for removing said second ends from each of said first and second pivot arms, said actuating means being linearly driven and operative to cause each of said pivot arms and said jaws to move an equal distance, a center line of said linearly moveable actuating means extending in the same plane as a center line extending through said skate blade and a center line extending through said sharpening wheel.

10. The skate sharpening apparatus of claim 9 wherein said actuating means includes first and second linking arms, each of said linking arms having a first end thereof connected to said second end of a respective one of said first and second pivot arms, said second ends of each of said first and second linking arms being connected to a linearly moveable actuator.

11. A skate holding device suitable for use in a skate sharpening apparatus, the skate holding device comprising:

a base;

first and second pivot arms each having first and second ends with each pivot arm being pivotably mounted intermediate said respective first and second ends;

first and second jaws for contacting opposite sides of a skate blade, said first ends of each of said first and second pivot arms being connected to said first and second jaws respectively, said first jaw having a first jaw plate member with a substantially flat jaw edge, said first jaw blade member being mounted to permit movement thereof such that said first clamp jaw edge remains parallel to a side of a skate blade held between said first and second jaws; and actuating means removing said second ends of each of said first and second pivot arms, said actuating means being operative to cause each of said pivot arms and said jaws to move an equal distance.

12. The skate holding device of claim 11 wherein said second jaw comprises a second jaw plate member, said second jaw plate member having first and second skate blade contacting fingers, said second jaw plate member being pivotably connected to said first end of said second pivot arm.

* * * * *